US009351897B1

(12) United States Patent
Woggon et al.

(10) Patent No.: US 9,351,897 B1
(45) Date of Patent: May 31, 2016

(54) METHOD OF NEUROMUSCULOSKELETAL PROPRIOCEPTIVE RE-EDUCATION AND DEVELOPMENT OF A LIVING BODY AND APPARATUS THEREFOR

(76) Inventors: Dennis A. Woggon, Rice, MN (US); A. Joshua Woggon, Dallas, TX (US); John D. Carlson, Saint Joseph, MN (US); Donald D. Winkels, Avon, MN (US)

( * ) Notice: Subject to any disclaimer, the term of this patent is extended or adjusted under 35 U.S.C. 154(b) by 685 days.

(21) Appl. No.: 13/595,624

(22) Filed: Aug. 27, 2012

Related U.S. Application Data

(63) Continuation of application No. 12/143,507, filed on Jun. 20, 2008, now Pat. No. 8,273,038, which is a continuation of application No. 10/865,517, filed on Jun. 9, 2004, now Pat. No. 7,402,145.

(51) Int. Cl.
*A61H 1/00* (2006.01)
*A61H 23/02* (2006.01)

(52) U.S. Cl.
CPC ..... *A61H 1/005* (2013.01); *A61H 23/0263* (2013.01); *A61H 2201/0149* (2013.01); *A61H 2201/1215* (2013.01); *A61H 2201/1427* (2013.01); *A61H 2201/165* (2013.01); *A61H 2201/1661* (2013.01); *A61H 2203/0406* (2013.01)

(58) Field of Classification Search
CPC ..... A61H 1/005; A61H 2201/0119; A61H 2201/0165; A61H 2201/0173; A61H 2201/1215; A61H 2201/1223; A61H 2201/164; A61H 2201/1642; A61H 2201/1661; A61H 2203/0406; A61H 2205/12; A61H 2205/125; A61H 23/0254–23/029; A61H 1/003; A61H 1/0255; A61H 1/0259; A61H 2201/0149; A61H 2201/1427; A61H 2201/165; A63B 21/00196
USPC ..... 601/29, 30, 31, 32
See application file for complete search history.

(56) References Cited

U.S. PATENT DOCUMENTS

| | | | | | |
|---|---|---|---|---|---|
| 2,235,158 | A * | 3/1941 | Krenzke | 601/65 |
| 2,566,484 | A * | 9/1951 | Coury | 601/65 |
| 3,140,711 | A * | 7/1964 | McGathey | 601/49 |
| 3,732,860 | A * | 5/1973 | Thurmer | 601/49 |
| 3,762,402 | A * | 10/1973 | Abramovitz | 601/65 |
| 4,967,736 | A * | 11/1990 | Spitzer | 601/35 |
| 5,046,485 | A * | 9/1991 | Slater | 601/65 |
| 5,348,370 | A * | 9/1994 | Fukuoka | 297/217.3 |
| 6,468,236 | B1 * | 10/2002 | Sumanac | 601/49 |
| 8,273,038 | B1 * | 9/2012 | Woggon et al. | 601/24 |
| 2004/0230142 | A1 * | 11/2004 | Park | 601/51 |

* cited by examiner

*Primary Examiner* — Valerie L Woodward
(74) *Attorney, Agent, or Firm* — Albert W. Watkins

(57) ABSTRACT

In combination, vertically percussive vibration and non-symmetrical forces are applied to a patient. The non-symmetrical forces may be generated by a variety of unevenly applied weights that are supported at appropriate body locations in a manner that upsets normal body load symmetry. The non-symmetrical forces in combination with vertically percussive vibrations induce neuromusculoskeletal proprioceptive re-education and development within a living body to correct musculo-skeletal disorders including but not limited to scoliosis. A special posture modifying chair and head-orienting glasses may be used instead of or in addition to unevenly applied weights. An additional force concentrating treatment apparatus is also presented.

7 Claims, 6 Drawing Sheets

METHOD OF NEUROMUSCULOSKELETAL PROPRIOCEPTIVE RE-EDUCATION AND DEVELOPMENT OF A LIVING BODY AND APPARATUS THEREFOR

CROSS REFERENCE TO RELATED APPLICATIONS

This application is a continuation of presently allowed Ser. No. 12/143,507 filed Jun. 20, 2008 now U.S. Pat. No. 8,273,038, which is in turn a continuation of Ser. No. 10/865,517 filed Jun. 9, 2004 and granted as U.S. Pat. No. 7,402,145 of the same title and inventorship, the contents of each which are incorporated herein by reference in entirety.

BACKGROUND OF THE INVENTION

1. Field of the Invention

This invention pertains generally to surgery, and more particularly to kinesitherapy apparatus and methods. Various manifestations most specifically pertain to apparatus and methods utilizing vibratory energy and unbalanced forces to treat neuromusculoskeletal disorders.

2. Description of the Related Art

A number of disorders are known which afflict the neuromusculoskeletal systems of vertebrates, the most notorious and of greatest interest both herein and in the prior art generally being those which more specifically afflict man and closely related mammals. Many of these disorders have been uniquely established through extensive research and field observation. The characteristics and symptoms of a myriad of such disorders permit them to be accurately diagnosed. However, once diagnosed, there is a serious need for the most rapid and effective treatments in order to alleviate, or where possible, cure the patient of the symptoms associated with the disorder. Unfortunately, many of these disorders arise through complex mechanisms which are not fully understood, and for which adequate treatments have not been arrived at. Furthermore, many of these disorders afflict both soft and hard tissues, which makes effective treatment all the more difficult.

One area of research in the treatment of humans involves the use of vibration, typically in concert with gravitational forces. Movements, such as various exercises, are known to be combined separately or in association with the vibration therapy, and are reported to be enhanced by the vibration. While much has been reported with regard to the general application of such therapies, nothing has been provided to enable a medical practitioner to specifically target a vibratory treatment to produce neuromusculoskeletal proprioceptive re-education within the living being. Exemplary of the prior art treatment methods are U.S. Pat. No. 4,928,959 by Bassett et al; U.S. Pat. No. 5,191,880 by McLeod et al; U.S. Pat. No. 5,273,028 by McLeod et al; U.S. Pat. No. 5,484,388 by Bassett et al; and U.S. Pat. No. 6,620,117 by Johnson et al, the contents of each which are incorporated by reference for their teachings of vibratory treatment and the myriad of disorders to which such treatments have been applied.

SUMMARY OF THE INVENTION

In a first manifestation, the present invention is a method of neuromusculoskeletal proprioceptive re-education and development of a living body. According to the method, a neuromusculoskeletal proprioceptive disorder is identified. Then at least one unbalanced external force magnitude and orientation which upsets a typical body orientation in a corrective manner is determined, and then an unbalanced external force is applied at the determined external force load magnitude and orientation. Vibratory energy is applied in the body during the force applying step to induce the desired neuromusculoskeletal proprioceptive re-education and development.

In a second manifestation, the invention is a method of using a vibrating device to provide localized vibratory excitation to a joint in a direction generally perpendicular to adjacent bones, localized to a specific location of a living body adjacent the joint, and having direction and magnitude of vibratory excitation to correct a musculo-skeletal disorder within the living body. According to the method, an elongate vibrating head is provided having a longitudinal axis parallel to a direction of elongation and a vibratory motion transverse thereto. The head also has an operatively incompressible dimension transverse to the longitudinal axis that is of a substantially similar order of magnitude to a dimension of the joint between said adjacent bones. The elongate vibrating head is placed generally perpendicular to the adjacent bones and generally adjacent the joint. Vibratory motion is produced, and coupled from vibrating head to joint with sufficient magnitude to correct a musculo-skeletal disorder within the living body.

In a third manifestation, the invention is an apparatus for neuromusculoskeletal proprioceptive re-education and development of a living body. A vibratory surface produces vertically oscillatory movements. A chair has a seat suitable for supporting a living body in a generally vertically oriented seated position. The seat may be removable therefrom to permit the living body to stand at least partially supported by said chair. A means is provided for varying an orientation of at least one bodily part of the living body from an orientation associated with an unloaded and relaxed position to a corrective position which upsets a typical body orientation in a corrective manner. The chair operatively couples vertically oscillatory movements from vibratory surface to living body.

In a fourth manifestation, the invention is a vibration platform apparatus operative for vibratory treatment of a living body. This apparatus consists essentially of at least one base foot suitable for carrying the vibration platform upon a fixed surface. A base member has a wall extending vertically from the base foot. A top plate forms a horizontal and planar top surface and a bottom surface. A lip circumscribes the vertically extending wall to define a gap, and the lip is coupled to and extends vertically down from a perimeter of the top plate by an amount nominally sufficient to prevent human digits from extending through the gap to a region between top plate and vertically extending wall, while still permitting air to flow through the gap. A rotary machine has a rotary shaft generating a motive force and a source of power. A means is provided for controlling application of power to the rotary electric machine. A mass is mechanically coupled to the top plate which oscillates vertically responsive to the motive force. At least one channel is provided that has a base coupled to the bottom surface of the top plate and a coupling region spaced from the top plate. A fastener passes through the coupling region and is restrained from motion relative thereto in a plane parallel to the top plate planar top surface and is able to move through a limited range in a direction normal thereto. A support is rigidly coupled to the vertically extending wall and has a coupling region to which the fastener is coupled and which restrains the fastener from motion relative thereto in a plane parallel to the top plate planar top surface and which permits the fastener to move through a limited range in a direction normal thereto. A resilient spacer is provided between channel and support that prevents contact therebetween, while still permits variation of spacing therebetween measured along a generally vertical axis. The spacer is cooperative with fastener to generally inhibit motion therebetween measured parallel to the top plate planar surface.

OBJECTS OF THE INVENTION

Exemplary embodiments of the present invention solve inadequacies of the prior art by providing a combination of vibrating device and weights, fixtures, or visual apparatus supported by some portion of the body in a manner that upsets normal body load symmetry in order to correct musculo-skeletal disorders.

A first object of the invention is to provide postural improvements and rehabilitation in the musculo-skeletal system, including the provision of more effective treatments for such afflictions as scoliosis and osteoporosis through the selective stimulation of osteoblast activity in association with improved blood and lymph circulation. A second object of the invention is to improve proprioception. Another object of the present invention is to provide increased general health, including neuromusculoskeletal, circulatory and immune systems while satisfying the other objectives. A further object of the invention is to provide an assortment of apparatus which may be used in meeting the foregoing objectives which provide safe and reliable operation, and which provide desired percussive treatment. Yet another object of the present invention is to enablement the treatment of a wide variety of neuromusculoskeletal disorders with comparable or increased efficacy using a small assortment of apparatus.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
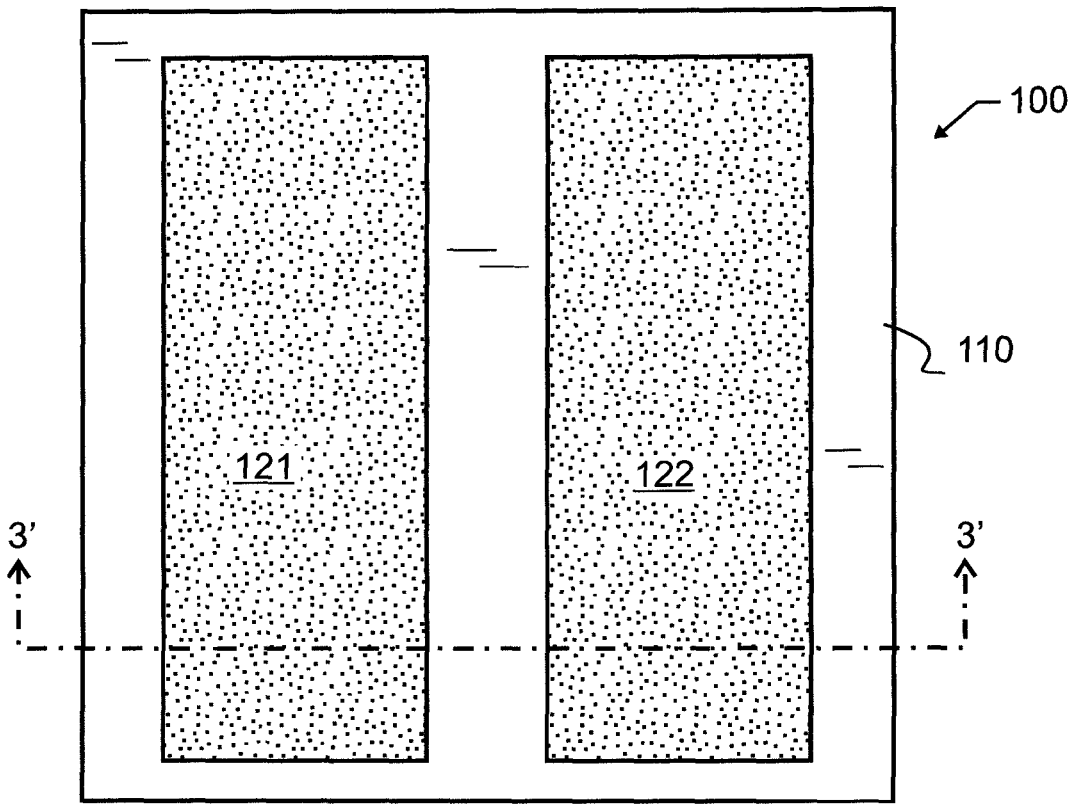
FIG. 1 illustrates a preferred embodiment vibration platform designed in accord with the teachings of the present invention from top plan view.
Figure 2:
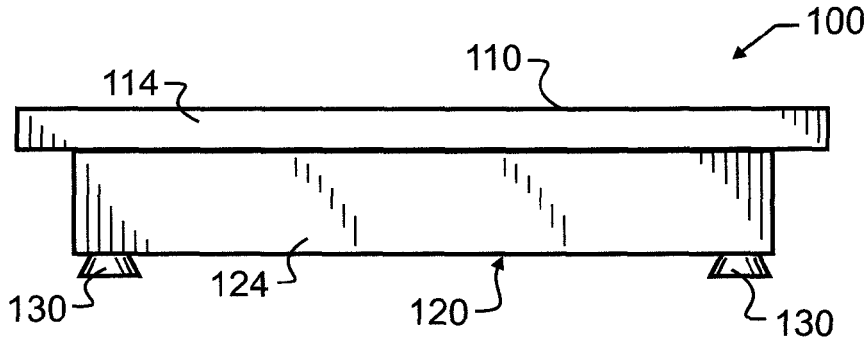
FIG. 2 illustrates the preferred embodiment vibration platform of FIG. 1 from a side plan view.
Figure 3:
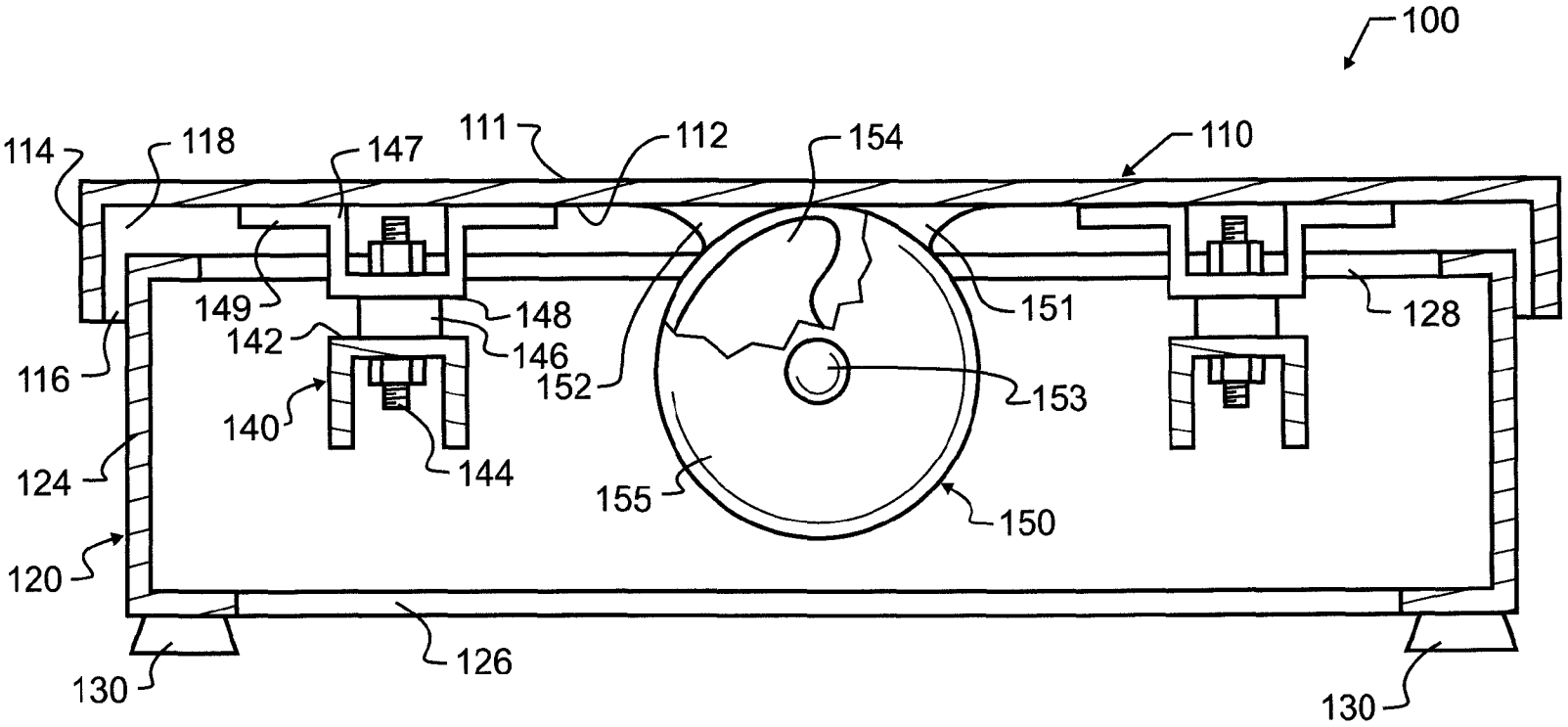
FIG. 3 illustrates the preferred embodiment vibration platform of FIG. 1 from a cross-sectional view taken along line 3' of FIG. 1.

Manifested in the preferred embodiment vibration platform 100 illustrated in FIGS. 1-3, the present invention provides an apparatus operative for vibratory treatment of a living body. While the most preferred embodiments pertain to treatment of humans, the applications are recognized herein as not being so limited, and other living beings having responsiveness to vibratory treatments are similarly contemplated herein. Any living vertebrate being will receive many of the benefits which are intended herein to be provided, owing to the piezoelectric nature of skeletal systems of such beings and the responsiveness of the neuromusculoskeletal systems to such stimulation.

Preferred vibration platform 100 as shown in FIG. 1 includes a top plate 110 with optional non-slip pads 121, 122. While not critical to the present invention, these pads 121, 122 are preferable to help to eliminate any possible motion between an object resting on top plate 110 and top plate 110. Pads 121, 122 are configured for an optimum combination of utility for varying applications, and so are placed as relatively large non-specific rectangles. However, it will be recognized that where a platform such as platform 100 has been designed for a singular application or much narrower utility, pads 121, 122 may be replaced by other structures or other geometries suitable for the function of relative coupling without motion, and may, for exemplary purposes only and not limiting thereto, include even diverse structures such as specific mechanical couplings or fasteners. Most preferably, pads 121, 122 will efficiently transmit vibratory energy through their thickness, and so in the preferred embodiment these pads 121, 122 are kept to a very minimal thickness. Moreover, they are preferably fabricated from a less resilient material, such as a resin-bonded abrasive or the like.

FIG. 2 illustrates the preferred vibration platform 100 from side view, and apparent therein is base member 120 which has a vertically extending wall 124 extending vertically from one or more base feet 130. Most preferably, base feet 130 are suitable for carrying vibration platform 100 upon a fixed surface such as a floor or the like. Base feet 130 will most preferably form at least some vibration isolation, and will also most preferably prevent relative motion between a floor and vibration platform 100. Consequently, in the preferred embodiment, base feet 130 comprise elastomeric cups which, when compressed, form a suction seal with smooth floor surfaces. The cup shape aids in dampening vibration, and the suction reduces the tendency for relative motion. As with the aforementioned pads 121, 122, the configuration of base feet 130 is not critical to the operation of the invention, and base feet 130 may be designed from a single foot traversing base member 120, or from a plurality of feet such as illustrated in FIG. 2. Further, the use of suction-type feet may be optimal for general purpose use including both smooth and coarse surfaces, but where a particular floor surface is known in advance, another geometry or material may be selected. Further, rather than feet, there may be provided an anchor or other fastener which couples directly to a floor or other static device or structure to provide suitable anchoring. For the purposes of the present disclosure, base feet will be understood to include any device or structure, or even a surface of base member 120 which contacts a supporting device or surface. Lip 114 is also visible in FIG. 2, and as illustrated therein in the preferred embodiment circumscribes a top edge of base member 120.

As will be evident from FIG. 3, lip 114 forms a gap 116 of limited size with vertically extending wall 124, and vertically extending wall 124 adjacent top rim 128 forms a gap 118 with a bottom surface 112 of top plate 110. Most preferably, the dimensions of gaps 116, 118 are such that a person or object inserted into gap 116 will be restricted in travel, and will be unable to enter into gap 118. Lip 114 is coupled to top plate 110 and extends vertically down from a perimeter of top plate 110 by an amount nominally sufficient to prevent human digits from extending through gap 116 to gap 118, even with possible knuckle bending and flexure. This is important to prevent accidental pinching or entrapment of human digits or other diverse objects too numerous to specifically mention herein. Nevertheless, gaps 116, 118 still provide adequate mechanical clearance between base member 120 and top plate 110, and also permit the passage of air therebetween. This latter function of air flow prevents the interior of base member 120 from excessively heating when motor 150 is in operation, by providing for natural convection of air.

In preferred embodiment vibration platform 100 illustrated in FIG. 3, base feet 130 are mounted to a small base rim 126 which is formed in base member 120. This rim provides structural integrity and ready placement of base feet 130, while still keeping base member 120 open for adequate convective air flow. As may also be apparent from the figure, top plate 110 has a relatively planar top surface 111 opposed to generally planar bottom surface 112.

Rotary electric motor 150 has a rotary shaft 153 which preferably generates motive force for the generation of vibration. As is well known in the field of electric motors, rotary electric motor 150 must have a source of electric power, such as a standard power cord that may be plugged into a wall outlet. In such case, a grommet may be provided through a hole in vertically extending wall 124 through which the power cord may pass, or the cord may be brought in through the opening in the bottom of base member 120 adjacent base rim 126. A means for controlling application of electric power to rotary electric motor 150 will also be provided, though this may be as simple as a wall plug removable from a wall outlet. Switches, electric or electronic motor controls, or other similar devices may be provided which either provide on-off control, or which may provide varying speeds within rotary electric motor 150. For clarity, the power cord and means for controlling application of electric power have not been illustrated herein, though it will be understood that there will be some source of electric power and means to control application, whether through a utility cord, battery, or other source and control means. While an electric motor is illustrated as the most preferred embodiment, those reasonably skilled in the art will understand that other motive power sources may be utilized to obtain the results and benefits provided by the present electric motor. Exemplary, though not solely limited to, are such alternatives as rotary machines powered not only by electric sources, but also rotary and other devices powered by pneumatics, hydraulics or the like. It will be apparent that rotary machines with different power sources could be directly substituted for the present rotary electric motor.

Most preferably, rotary electric motor 150 is rigidly affixed to top plate 110 through a pair of motor brackets 151, 152. An eccentric weight 154 is preferably incorporated internally within motor housing 155, which is unbalanced with respect to rotation about motor shaft 153. As should be apparent, motor shaft 153 defines an axis of rotation, and if a mass such as eccentric weight 154 is unbalanced with respect thereto, motor 150 will be caused to vibrate. Since motor 150 is rigidly affixed to top plate 110, eccentric weight 154 will be mechanically coupled to top plate 110, which will in turn oscillate vertically responsive to motive force being applied to eccentric weight 154.

The use of an internal eccentric weight 154 is most preferred, since there are no exposed moving parts which may become entangled in other articles, devices, materials or the like. Motor housing 155 acts as a highly desired shield. However, it will be understood that other structures and devices known to induce vibration in top plate 110 may be incorporated. Further, it will be recognized that eccentric weight 154 need not be directly coupled to motor shaft 153, and intermediate power transmission devices such as pulleys, gearboxes and the like may also be included without departing from the spirit of the present invention. Nevertheless, the internally weighted motor 150 of the preferred embodiment is most desired in view of the aforementioned safety and simplicity factors.

Rigid coupling of rotary electric motor 150 to top plate 110 is of much less value unless an elastic coupling is provided between top plate 110 and base member 120. However, top plate 110 must still be designed to support adequate loads upon relatively planar top surface 111 without eliminating the desired elasticity. Furthermore, the coupling will most preferably be designed to permit substantial percussive energy transfer in a vertical direction, while minimizing energy transfer in a plane parallel to relatively planar top surface 111. This percussive and generally vertical energy has been found to be most beneficial for a number of preferred applications discussed in greater detail herein below. The preferred coupling is achieved through the provision of a pair of supports 140 which extend from one face of vertically extending wall 120 to an opposite face. These supports 140 provide enhanced structural rigidity, and provide a coupling region 142 through which a fastener 144 may pass. Fastener 144 will most preferably be restrained from motion relative to supports 140 in a plane parallel to relatively planar top surface 111, but will be permitted to move through a limited range in a direction normal thereto. This limited range of motion normal to relatively planar top surface 111 permits the desired vertical percussive energy transfer, while restricting undesired horizontal motion. A channel 147 of limited length, width and height is provided which is most preferably shaped as shown, to provide mounting wings 149 which may be spot welded or otherwise rigidly affixed to top plate 110, while providing a coupling surface 148 that enables access for fastener 144. A resilient spacer 146 is located between channel 147 and support 140, preventing contact therebetween, while permitting the vertical variation of spacing therebetween representative of the vertical percussive energy transfer. The amount of motion in the vertical direction may be measured along a generally vertical axis. Most preferably, resilient spacer 146 will be cooperative with fastener 144 to generally inhibit relative motion parallel to top plate 110. In the preferred embodiment, resilient spacer 146 is an elastomeric bushing, which provides excellent resilience along the vertical axis. However, other materials or combinations may be used, including but not limited to such devices as metal or other springs, and may additionally include various suspension components such as shock absorbers, dampeners or the like as desired for a particular application. However, care must be taken to ensure adequate movement while still preserving a reasonable load capacity. Said another way, too great a vertical load will simply flatten resilient spacer 146. As evident in FIG. 3, two pairs of channels 147 and supports 140 are provided, with supports 140 extending parallel to motor shaft 153. Each pair of channels 147 will most preferably be distally spaced along an associated support 140, which provides a four point support for top plate 110, at locations within but towards the corners of top plate 110, while rotary electric motor 150 is preferably placed adjacent the geometric center of top plate 110.

Figure 4:
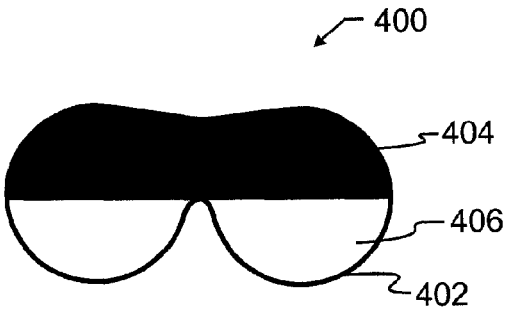
FIG. 4 illustrates a preferred embodiment visual aid designed in accord with the teachings of the present invention from front plan view.

Vibration platform 100 as illustrated in FIGS. 1-3 provides an optimal source for vertical percussive energy. However, additional apparatus and methods are required to capitalize on the treatment of certain neuromusculoskeletal proprioceptive disorders, to adequately enable satisfactory neuromusculoskeletal proprioceptive re-education and development. A preferred method will comprise the steps of identifying the neuromusculoskeletal proprioceptive disorder; determining at least one unbalanced external force magnitude and orientation which upsets a typical body orientation in a corrective manner; applying an unbalanced external force at the at least one unbalanced external static force load magnitude and orientation; and inducing vibratory energy in the living body during the applying step to induce neuromusculoskeletal proprioceptive re-education and development. Identification of neuromusculoskeletal proprioceptive disorders is well documented in the medical literature and will not be repeated herein. Once the disorder is identified, an orientation will need to be identified which will alter the typical body orientation of the living body and permit vibratory correction. The treatments, using the methods and apparatus disclosed herein, may include both traction and decompression. FIG. 4 illustrates one such technique for generating appropriate orientation, using a pair of specially configured glasses 400. These glasses 400 have the typical frame 402 and non-corrective lenses 406, though corrective lenses may be used if designed for one or a few select individuals. One portion of lenses 406 may be covered with an opaque material 404, and the portion will most preferably include a major portion of lenses 406. The opaque or covered portion will most preferably include straight forward vision, and may be controlled, such as with electrical tape or the like, to cover more of the field of vision. A person wearing glasses 400 will be forced to tilt their head back to see an object straight ahead. Consequently, glasses 400 may be used to selectively control orientation of a patient's head. The force will be understood in this instance to originate from a non-mechanical force, and instead will be the emotional force of desiring to observe objects straight ahead. This will in turn lead to the generation of an unbalanced force upon the wearer's neck, which will in turn orient the body in a corrective manner.

Figure 10:
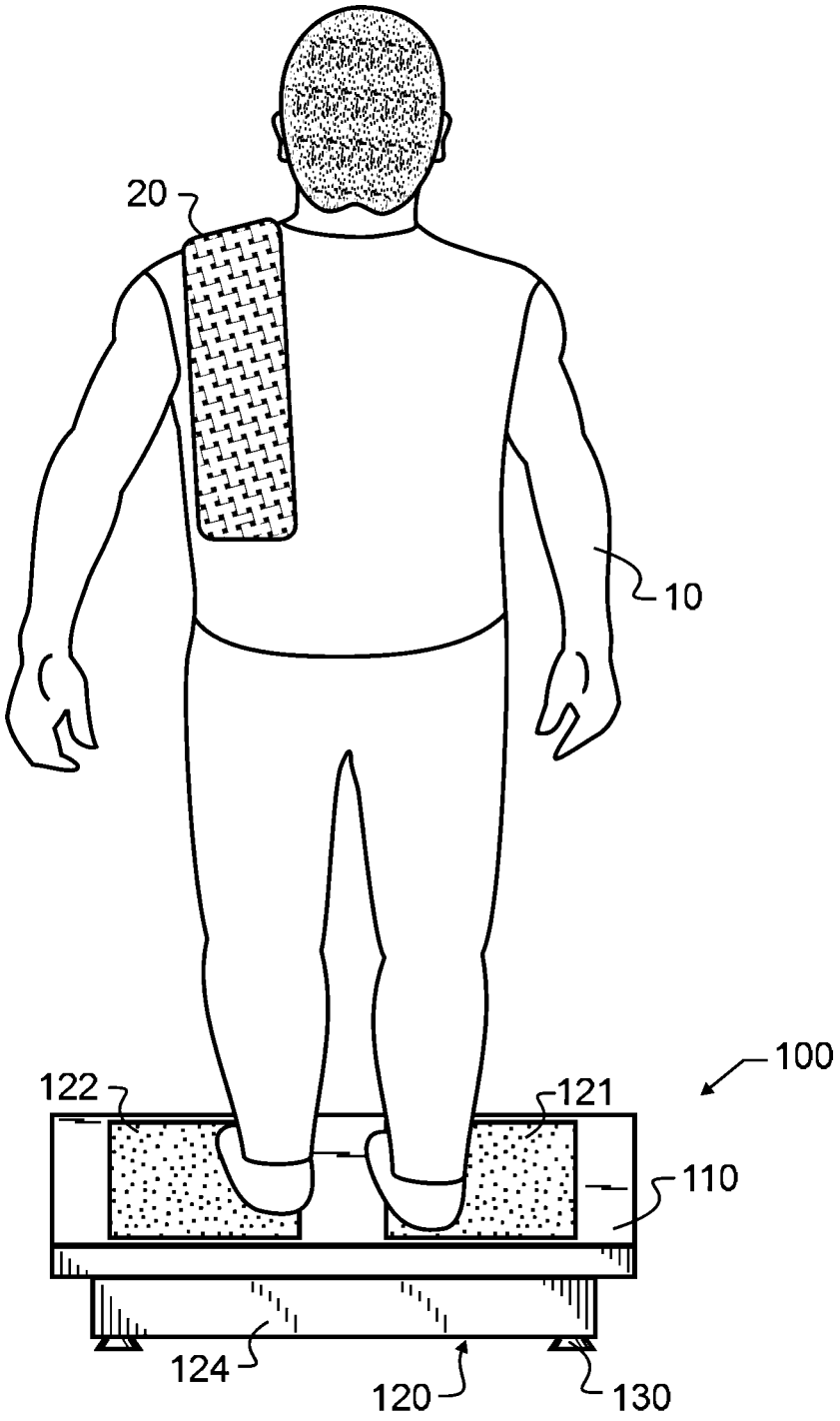
FIG. 10 illustrates the preferred embodiment vibration platform of FIG. 1 in further combination with a human and a weight draped over a shoulder from a back perspective view.

Other mechanical forces may also be applied. Among the forces contemplated herein are a vest having weights retained at various selective locations thereon; a jacket having weights retained at various selective locations thereon; a weight worn upon a head of a living body; a weighted wrap installed around at least one limb of a living body; a weighted wrap installed around the torso of a living body; and a weight draped over some portion of the living body. FIG. 10 illustrates the preferred embodiment vibration platform of FIG. 1 in further combination with a person 10 and a weight 20 draped over a shoulder. It will be understood that the aforementioned list is for illustrative purposes only, demonstrating the preferred embodiment in accord with the requirements of the statute, and that other techniques too numerous to individually describe herein will become apparent to those skilled in the art upon a review of the present disclosure and that these other techniques are considered to be incorporated herein. Important however is that the force as applied is unbalanced about an axis of symmetry. In other words, the lack of symmetry of application upon the living being will result in a bodily shift from typical orientation to a corrective orientation.

Figure 5:
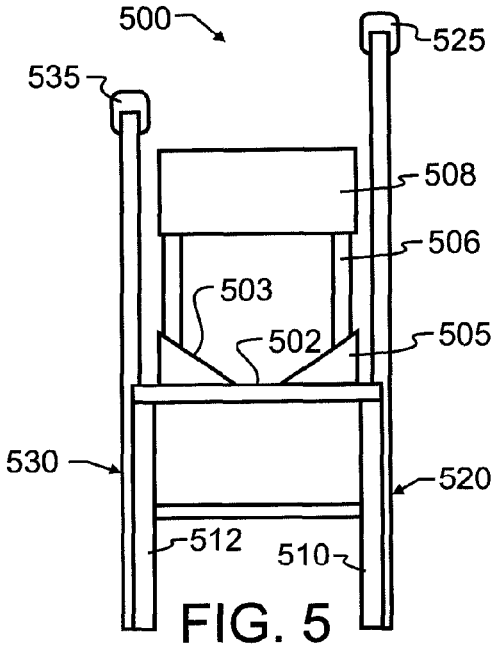
FIG. 5 illustrates a preferred embodiment chair designed in accord with the teachings of the present invention from front plan view.
Figure 7:
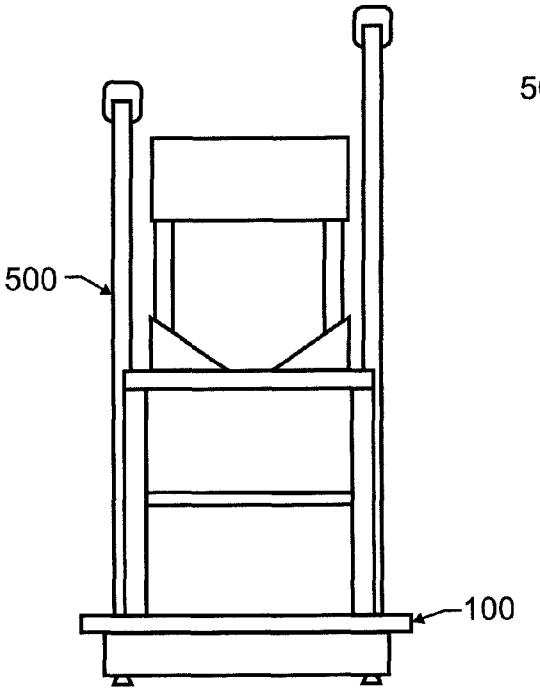
FIG. 7 illustrates the preferred combination vibration platform of FIG. 1 and chair of FIG. 5 from a front plan view.
Figure 6:
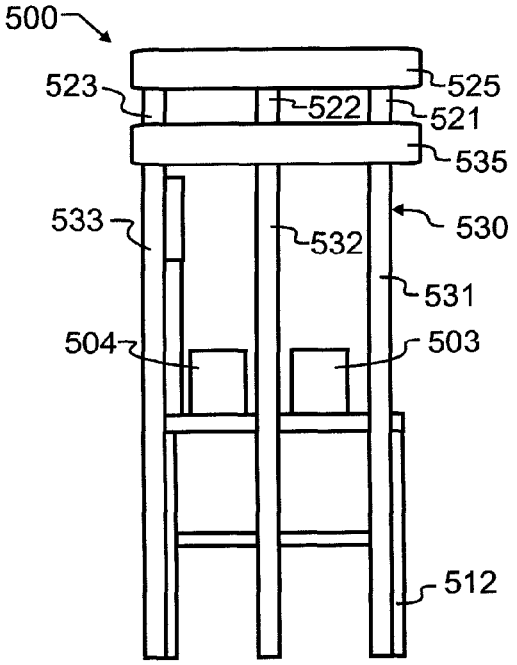
FIG. 6 illustrates the preferred embodiment chair of FIG. 5 from a side plan view.

Vibration, specially placed weights and field-of-vision limiting glasses may further be used in combination with a chair 500 illustrated in FIGS. 5-7 which has been specially designed for the treatment of scoliosis, but which will also have application in other neuromusculoskeletal proprioceptive disorders. Chair 500 will most preferably include a typical seat 502 upon which a person may sit, but will also preferably include a set of cushions 503-505 which will permit the person's pelvis to be oriented angularly with respect to seat 502, where required for treatment. In addition, seat 502 will most preferably be removable, to permit a person to stand within the confines of the chair as well. Such arrangement permits the framework and armrests to be utilized, which is most beneficial in some applications. Back support 508 is spaced from seat 502 by back extensions 506, though this arrangement is not consequential to the preferred embodiment. A standard base including legs 510, 512 is illustrated, but extending adjacent therefrom are vertical arm supports 520, 530 which include individual vertical arm support members 521-523 and 531-533. Most preferably, these individual vertical arm support members 521-523 and 531-533 are coupled to legs 510, 512 in such a way as to permit both height and forward-backward movement of each arm rest 525, 535. Consequently, and as illustrated, arm rests 525, 535 may be set at different positions to bias a person within chair 500. Furthermore, where desired, various straps or tensioning means may be wrapped about the person to better locate them within chair 500. As illustrated in FIG. 7, this chair 500 is further combined with vibration platform 100, which combination provides enhanced treatment of neuromusculoskeletal proprioceptive disorders. As may be apparent therein, a person may be oriented with their spine generally parallel to the gravitational axis, and percussive linear vibration may be induced in an orientation generally parallel to the same gravitational axis. As aforementioned, additional weights, glasses and the like may be further combined.

Figure 8:
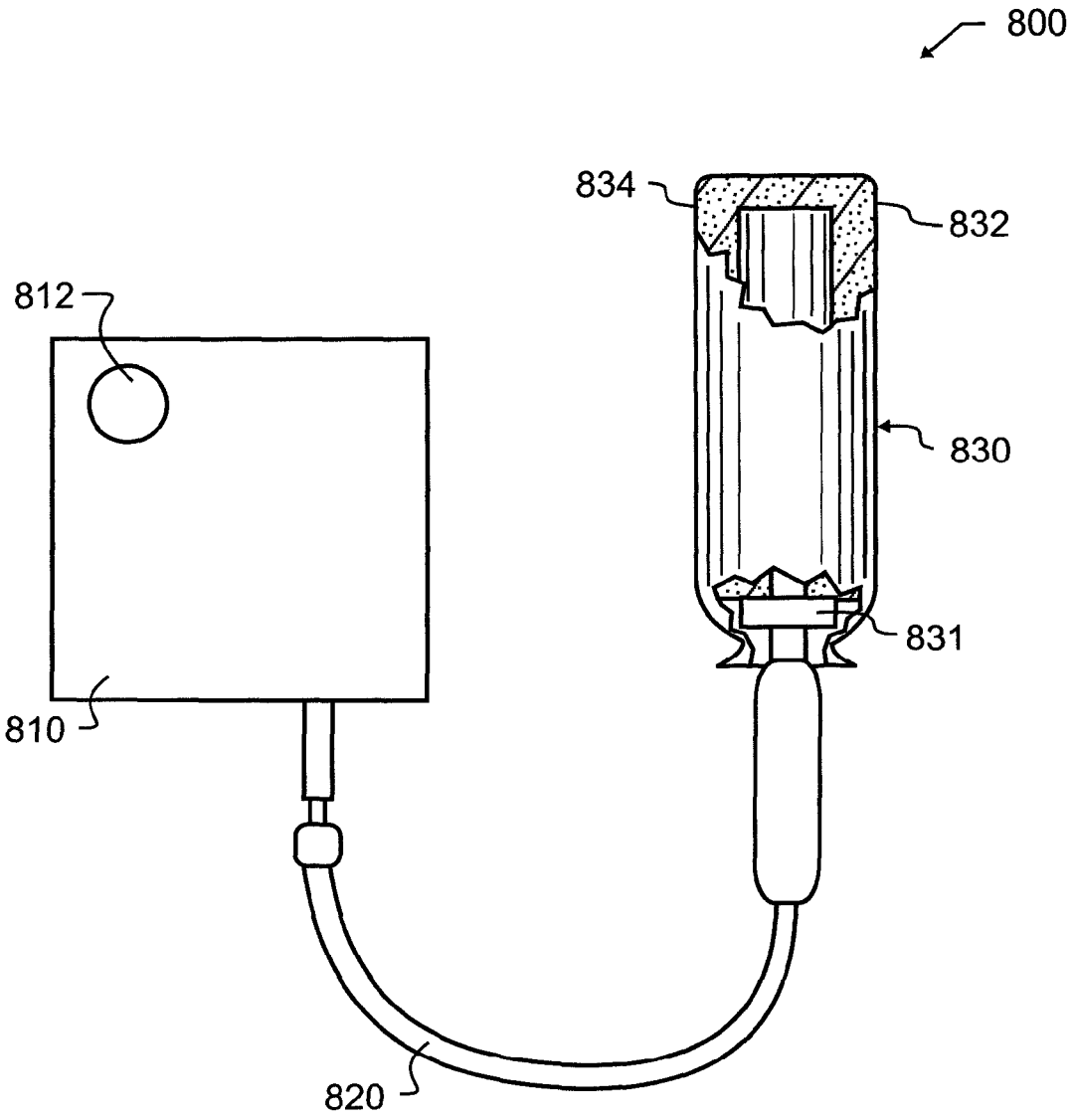
FIG. 8 illustrates an alternative embodiment vibration apparatus designed for localized treatment in accord with the teachings of the present invention from top plan view.
Figure 9:
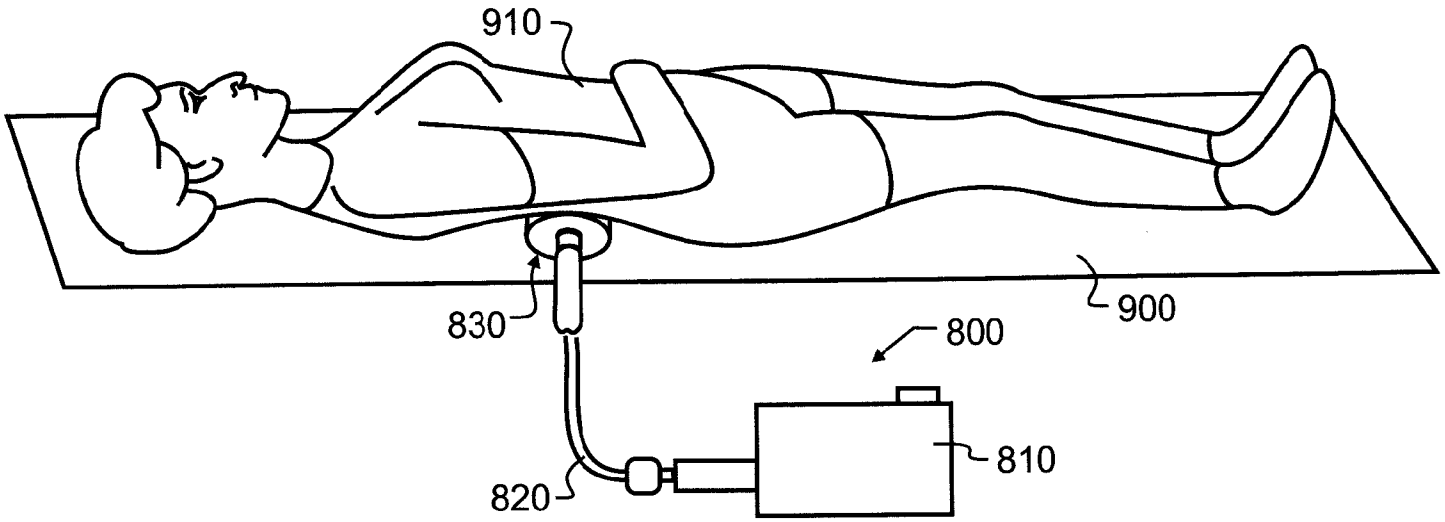
FIG. 9 illustrates a preferred method of treatment utilizing the preferred embodiment localized vibration apparatus of FIG. 8 by projected plan view.

FIGS. 8 and 9 illustrate an alternative embodiment vibration apparatus 800 and treatment method designed for localized treatment in accord with the teachings of the present invention. As illustrated therein, the alternative embodiment vibration apparatus 800 includes a motor and control housing 810 having a power control 812, which may, for exemplary purposes but not limited thereto, include such devices as timers and power switches. Motor and control housing 810 is coupled to a flexible rotary power shaft 820 which transmits rotary power produced within motor and control housing 810 there through to elongate vibrating head 830. Flexible rotary power shaft 820 will most preferably include known and available features such as break-away technology wherein flexible rotary power shaft 820 will disconnect input from output in the event excessive force differentials are created or flexible rotary power shaft 820 becomes twisted. These safety features protect a person to which vibratory energy is being applied in the unlikely event of a component failure.

Most preferably, elongate vibrating head 830 has a longitudinal axis parallel to a direction of elongation, which in the present embodiment is parallel to flexible rotary power shaft 820 at the coupling 831 with elongate vibrating head 830. Elongate vibrating head 830 has a force applicator 832 which is preferably operatively incompressible on an exterior thereof, and which has an internally offset and/or otherwise unbalanced internal weight which induces vibratory motion transverse to the longitudinal axis when rotated. A protective cover 834 may be further provided which may be of very low density foam or the like, intended primarily to prevent entanglement of hair with what would otherwise be preferably very minimally exposed rotating components such as bearing seals and the like.

In the most preferred method illustrated in FIG. 9, vibration apparatus 800 is applied directly to a localized area or region of a living being, most preferably generally perpendicular to adjacent bones. In the illustration, elongate vibrating head 830 is transverse to the spine of person 910. Most preferably, the radius of force applicator 832 is of a substantially similar order of magnitude to a dimension of said joint between said adjacent bones. For the purposes of the present disclosure, "substantially similar order of magnitude" will be understood herein to be within one factor of ten of the total joint dimension. This ratio permits force applicator 832 to provide localized vibratory excitation to a joint in a direction generally perpendicular to adjacent bones which is localized to a specific location of a living body. The direction and magnitude of vibratory excitation will be selected to correct a musculo-skeletal disorder within the living body. The vibratory motion must be coupled from elongate vibrating head 830 to joint with sufficient magnitude to correct a musculo-skeletal disorder within living body 910. As may be apparent, prior art stimulators were designed for massage purposes, and so were not equipped with adequate power to correct musculo-skeletal disorders, but instead were solely directed towards treatment of soft tissues. As illustrated in FIG. 9, in the most preferred method living body 910 will be supported upon a generally fixed support 900. A gap is formed between living body 910 and generally fixed support 900. Elongate vibrating head 830 is slipped within the gap, and living body 910 is then permitted to rest under at least a gravitational force against elongate vibrating head 830.

As with chair 500, additional massive load may be applied to at least a portion of the specific treatment location of living body 910 to upset a typical body orientation about the joint. This will be done in a manner to achieve correction of a musculo-skeletal disorder within living body 910. Further, and as aforementioned, the therapies and techniques, using the methods and apparatus disclosed herein, may include both traction and decompression in any combination with any or all of the various apparatus and weights illustrated herein.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

We claim:

1. A vibration platform apparatus operative for vibratory treatment of a living body, consisting essentially of:

at least one base foot operatively supporting a vibration platform upon a fixed surface;

a base member extending vertically from said at least one base foot;

a top plate forming a horizontal and planar top surface configured to support a person standing vertically thereupon;

a machine that has a shaft generating a motive force and a source of power;

a means for controlling application of power to said machine;

a mass configured to be operatively motively driven by said machine and coupled to said top plate, thereby operatively transmitting vibrations generated by said mass to said top plate and induced in said top plate as a percussive, primarily linear vibration in an orientation generally parallel to a gravitational axis;

a resilient spacer between said base member and said top plate preventing contact therebetween while permitting variation of spacing therebetween measured along a generally vertical axis; and a weight configured to be supported upon said person and unbalanced about a body axis of symmetry of said person and thereby configured to upset a typical body orientation in a corrective manner.

2. The vibration platform apparatus operative for vibratory treatment of a living body of claim 1, wherein said weight further comprises a vest having weights retained at various selective locations thereon.

3. The vibration platform apparatus operative for vibratory treatment of a living body of claim 1, wherein said weight further comprises a weighted wrap installed around said person.

4. The vibration platform apparatus operative for vibratory treatment of a living body of claim 1, wherein said weight further comprises a weight worn upon a head of said person.

5. The vibration platform apparatus operative for vibratory treatment of a living body of claim 1, wherein said weight further comprises a weight draped over a portion of said person.

6. A vibration platform apparatus operative to rest upon a fixed surface and to support a person thereon for vibratory treatment, comprising:

at least one base foot operatively supporting a vibration platform upon said fixed surface;

a top plate forming a horizontal and planar top surface and a bottom surface generally opposed to said horizontal and planar top surface configured to support a person standing vertically thereupon;

a base member having a substantially open bottom adjacent said at least one base foot operative for adequate convective air flow, a perimeter extending vertically from said at least one base foot and defining an interior of said base member generally bounded by said top plate bottom surface, said perimeter wall and said fixed surface;

a rotary machine that has a rotary shaft rotating about a rotary axis and generating a motive force and that has a source of power;

a means for controlling application of power to said rotary machine;

a mass unbalanced about and rigidly affixed to said rotary shaft and operatively rotating about said rotary axis when said rotary shaft rotates, and operatively motively driven about said rotary axis by said rotary machine and coupled to said top plate and thereby operatively coupling vertical percussive energy from said rotary machine and said unbalanced mass to said top plate; and a weight configured to be supported upon said person and unbalanced about a body axis of symmetry of said person and thereby configured to upset a typical body orientation in a corrective manner.

7. The vibration platform apparatus of claim 6, further comprising a resilient spacer coupled between said top plate and said vertically extending wall which operatively restrains said top plate from motion in a plane parallel to said top plate planar top surface and which permits said top plate to move through a limited range in a direction normal thereto.

* * * * *